US010232646B2

(12) United States Patent
Tokuhara et al.

(10) Patent No.: US 10,232,646 B2
(45) Date of Patent: Mar. 19, 2019

(54) PRINTER

(71) Applicant: FUJITSU COMPONENT LIMITED, Tokyo (JP)

(72) Inventors: Yayoi Tokuhara, Tokyo (JP); Masahiro Kaneko, Tokyo (JP); Nobuo Yatsu, Tokyo (JP); Miki Kitahara, Tokyo (JP); Kohei Takahashi, Tokyo (JP); Katsuaki Koshimura, Tokyo (JP); Chuqi Liang, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/585,427

(22) Filed: May 3, 2017

(65) Prior Publication Data

US 2018/0009242 A1 Jan. 11, 2018

(30) Foreign Application Priority Data

Jul. 5, 2016 (JP) ..... 2016-133770

(51) Int. Cl.
*B41J 2/32* (2006.01)
*B41J 11/04* (2006.01)

(52) U.S. Cl.
CPC *B41J 11/04* (2013.01); *B41J 2/32* (2013.01)

(58) Field of Classification Search
CPC ... B41J 11/04; B41J 11/057; B41J 2/32; B41J 11/06; B41J 2/01; B41J 11/20
USPC ..... 347/101, 104, 197, 220
See application file for complete search history.

(56) References Cited

U.S. PATENT DOCUMENTS 4,728,967 A 3/1988 Tomita et al.
2016/0200473 A1* 7/2016 Nitta ..... B41J 11/04 492/27

FOREIGN PATENT DOCUMENTS

| | | |
|---|---|---|
| CN | 201102361 Y | 8/2008 |
| CN | 105517808 A | 4/2016 |
| JP | 4-259577 | 9/1992 |
| JP | 6-30856 | 4/1994 |

OTHER PUBLICATIONS

Japanese Platform for Patent Information, Publication No. 4-259577, published Sep. 16, 1992.
Espacenet English abstract corresponding to Chinese Patent Publication No. 105517808 A, published Apr. 20, 2016.
Espacenet English abstract corresponding to Chinese Patent Publication No. 201102361 Y, published Aug. 20, 2008.
Chinese Office Action dated Sep. 28, 2018 in corresponding Chinese Patent Application No. 201710504265.9.

* cited by examiner

*Primary Examiner* — Jannelle M Lebron
(74) *Attorney, Agent, or Firm* — Staas & Halsey LLP

(57) ABSTRACT

A printer including: a platen roller; a housing that holds the platen roller; and a print head that is mounted on the housing and performs printing on a sheet; wherein the platen roller includes a columnar straight part, and a first taper part that is formed on both ends of the straight part and has a diameter which changes towards an outside from the straight part along an axial direction.

7 Claims, 12 Drawing Sheets

PRINTER

CROSS-REFERENCE TO RELATED APPLICATION

This application is based upon and claims the benefit of priority of the prior Japanese Patent Application No. 2016-133770 filed on Jul. 5, 2016, the entire contents of which are incorporated herein by reference.

FIELD

A certain aspect of the embodiments is related to a printer.

BACKGROUND

There has been known a card conveying device that holds a card between a print head and a platen roller and conveys the card by the rotation of the platen roller (e.g. see Patent Document 1: Utility Model Application Laid-Open Publication No. 6-30856). By making the surface of this platen roller into a hand drum shape, a conveying amount per one rotation of both ends of the platen roller becomes large and the conveying amount per one rotation of the center of the platen roller becomes small. Therefore, a centering force occurs against the card. By making the surface of the platen roller into a taper shape and pressing the card to a guide in the side of a small conveying amount, the meandering of the conveyance of the card is suppressed.

SUMMARY

According to an aspect of the present invention, there is provided a printer including: a platen roller; a housing that holds the platen roller; and a print head that is mounted on the housing and performs printing on a sheet; wherein the platen roller includes a columnar straight part, and a first taper part that is formed on both ends of the straight part and has a diameter which changes towards an outside from the straight part along an axial direction.

The object and advantages of the invention will be realized and attained by the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In the card conveying device of the Patent Document 1, when a sheet softer than the card is used, a wrinkle might occur in the center of the width direction of the sheet. Moreover, when the sheet skews in a printer, the sheet contacts a guide part of a platen roller unit, and folding of the sheet occurs.

A description will now be given of embodiments according to the present invention with reference to the drawings.

Figure 1:
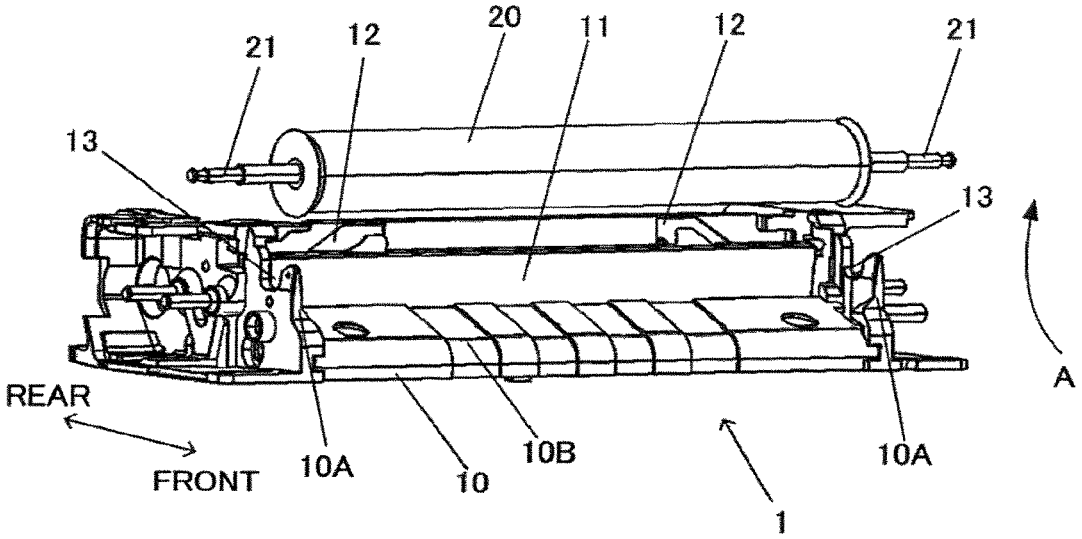
FIG. 1 is a perspective view of a platen roller unit and a platen roller included in a thermal printer according to a present embodiment.

FIG. 1 is a perspective view of a platen roller unit and a platen roller included in a thermal printer according to one embodiment.

A platen roller unit 1 includes a housing 10 and a thermal head 11 that performs printing on a sheet by heat. Concave parts 13 are formed on right and left wall parts 10A of the housing 10, and a shaft 21 of a platen roller 20 is fitted in and fixed to the concave parts 13. The shaft 21 is a rotational shaft which passes through the center of the platen roller 20.

The thermal head 11 is mounted on the housing 10 so as to move in front and rear directions. Moreover, a spring 12 is fixed between the housing 10 and the thermal head 11, and the spring 12 urges the thermal head 11 in a front direction (i.e., a direction toward the platen roller 20). When the shaft 21 of the platen roller 20 is attached to the concave parts 13, the platen roller 20 is opposite to and contacts the thermal head 11. When a roll thermal paper (hereinafter referred to as "a sheet") is inserted between a base 10B of the housing 10 and the platen roller 20, for example, the sheet is conveyed towards the thermal head 11 by the rotation of the platen roller 20. The sheet is nipped between the thermal head 11 and the platen roller 20 and is printed by the thermal head 11. The printed sheet is discharged in an upper direction of FIG. 1. Here, an A-direction of FIG. 1 indicates a conveyance direction of the sheet.

Figure 2A:
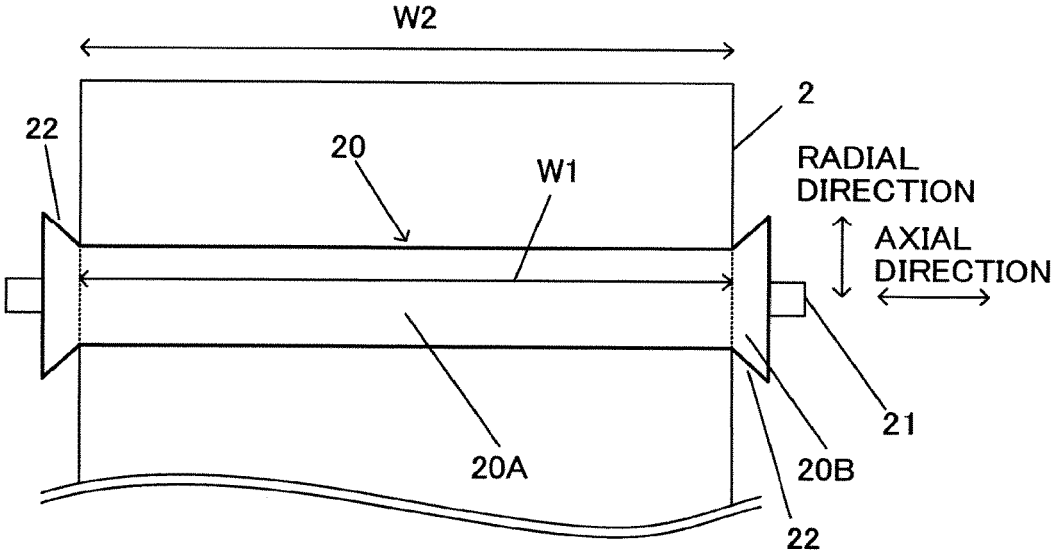
FIG. 2A is a diagram illustrating a position relationship of a platen miler 20 and a sheet 2.
Figure 2B:
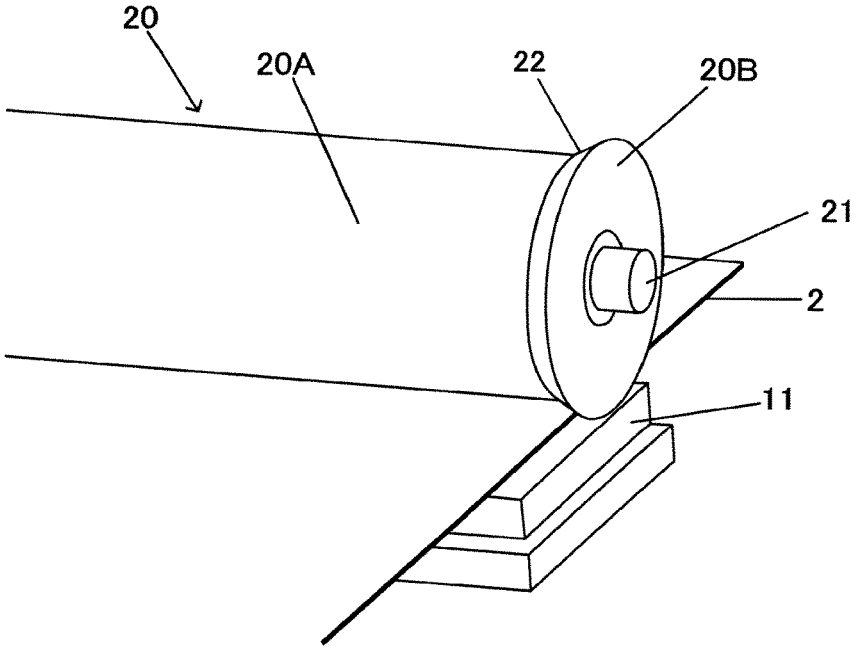
FIG. 2B is a perspective view illustrating the position relationship of a thermal head 11, the platen roller 20 and the sheet 2.

FIG. 2A is a diagram illustrating a position relationship of the platen roller 20 and a sheet 2. FIG. 2B is a perspective view illustrating the position relationship of the thermal head 11, the platen roller 20 and the sheet 2.

The platen roller 20 is made of a heat-resistant rubber which does not melt at a temperature of the thermal head 11. Moreover, the platen roller 20 includes a columnar straight part 20A, and taper parts (a first taper part) 20B that are formed on both ends of the straight part 20A and have a diameter which continuously or linearly increases towards the outside from the straight part 20A along an axial direction. Each taper part 20B includes an inclined plane 22 formed so that the diameter of the taper part 20B continuously increases. The diameter of the straight part 20A is constant. The taper parts 20B are formed integrally with the straight part 20A, but may be formed separately from the straight part 20A. When the taper parts 20B are formed separately from the straight part 20A, for example, members corresponding to the taper parts 20B cover both ends of a member corresponding to the straight part 20A, and the whole shape becomes the shape of the platen roller 20 illustrated in FIG. 2. A width W1 of the straight part 20A is equal to or more than a width W2 of the sheet 2.

Figure 3A:
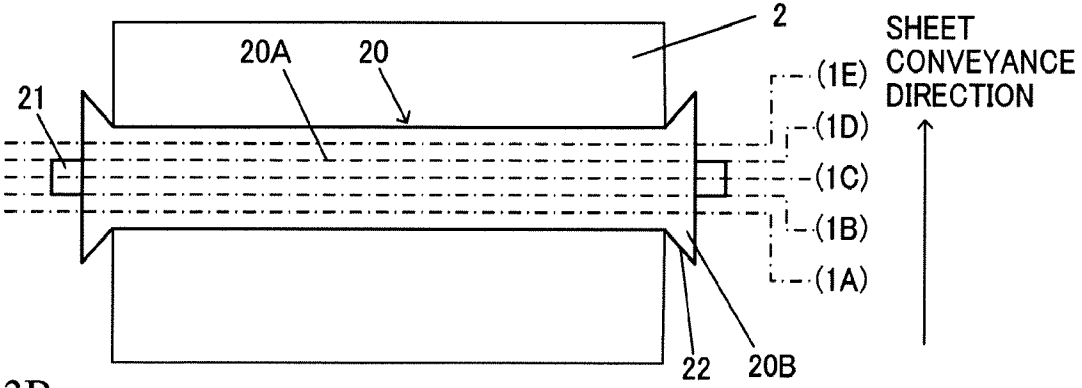
FIG. 3A is a diagram illustrating the position relationship of the platen roller 20 and the sheet 2.
Figure 3B:
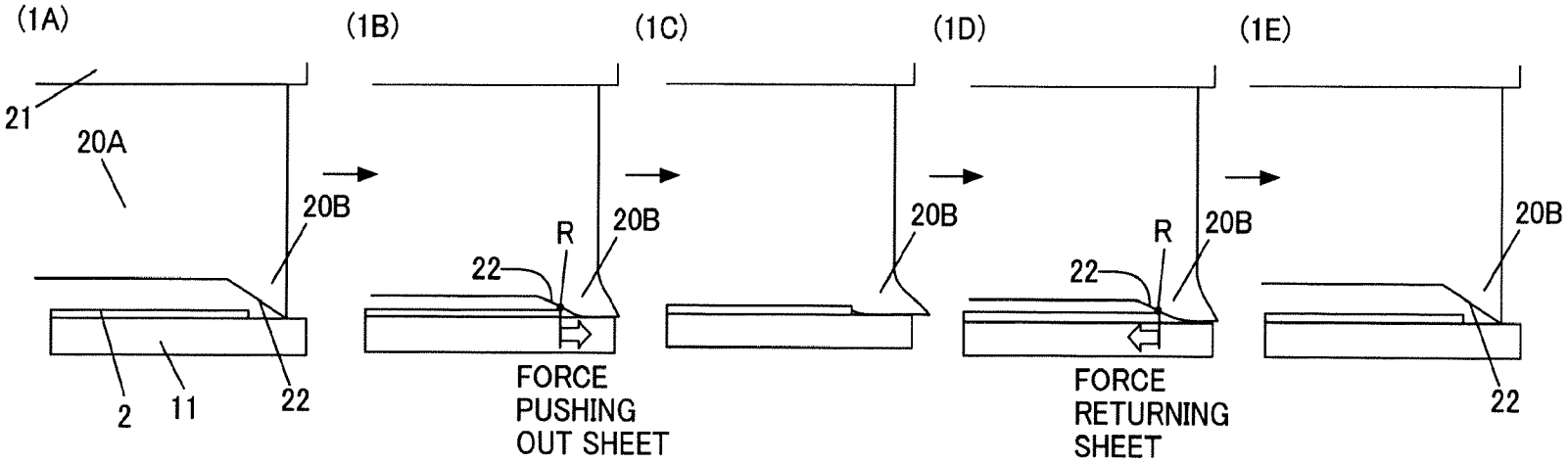
FIG. 3B is a diagram illustrating the state transition of the thermal head 11, a taper part 20B of the platen roller 20 and the sheet 2.

FIG. 3A is a diagram illustrating the position relationship of the platen roller 20 and the sheet 2. FIG. 3B is a diagram illustrating the state transition of the thermal head 11, the taper part 20B of the platen roller 20 and the sheet 2.

Codes "1A" to "1E" of FIG. 3A indicate positions of the platen roller 20 opposite to the sheet 2, respectively. Codes "1A" to "1E" of FIG. 3B illustrate partial cross sectional views of right ends of the thermal head 11, the platen roller 20 and the sheet 2 at positions of the codes "1A" to "1E" of FIG. 3A. It is assumed that a part of the sheet 2 protrudes to a position opposite to the taper port 20B in FIG. 3B.

First, at the position "1A" of FIG. 3B, the taper part 20B begins the deformation and lightly contacts the thermal head 11, but the platen roller 20 does not touch the sheet 2. At the position "1B" of FIG. 3B, the taper part 20B continues the deformation and contacts a right end R of the sheet 2. When the taper part 20B contacts the right end R of the sheet 2, a force that pushes out the sheet 2 to the outside of the platen roller 20 is applied to the right end R of the sheet 2, by a frictional force between the taper part 20B and the sheet 2 and the deformation of the taper part 20B. However, the taper part 20B contacts the thermal head 11, and therefore the sheet 2 does not jump out to the outside of the platen roller 20.

A position "1C" of FIG. 3B is a lowest point of the platen roller 20. The taper part 20B is crushed, the sheet 2 is nipped between the platen roller 20 and the thermal head 11, and printing is performed. Also, the taper pan 20B contacts the thermal head 11, and therefore the sheet 2 does not jump out to the outside of the platen roller 20. At a position "1D" of FIG. 3B, the deformation of the taper part 20B begins to be restored, and the inclined plane 22 of the taper part 20B contacts the right end R of the sheet 2. When the inclined plane 22 of the taper part 20B contacts the right end R of the sheet 2, a force that returns the sheet 2 to the inside of the platen roller 20 is applied to the right end of the sheet 2. At the position "1E" of FIG. 3B, the deformation of the taper part 20B is restored, the taper part 20B lightly contacts the thermal head 11, and the platen roller 20 does not contact the sheet 2.

As described above, the platen roller 20 includes the taper parts 20B that are formed on both ends of the straight part 20A and have the diameter which increases towards the outside from the straight part 20A along the axial direction. Therefore, even when the part of the sheet 2 protrudes to the position opposite to the taper part 20B, the sheet 2 does not jump out to the outside of the platen roller 20. It is possible to prevent the sheet 2 from folding. Moreover, since the platen roller 20 includes the columnar straight part 20A which has no irregularity and is not a hand drum shape, a force in which the right and left ends of the sheet 2 advance to a central part of the platen roller 20 does not occur in the sheet 2, and it is possible to prevent a wrinkle from occurring on the sheet 2.

Figure 4A:
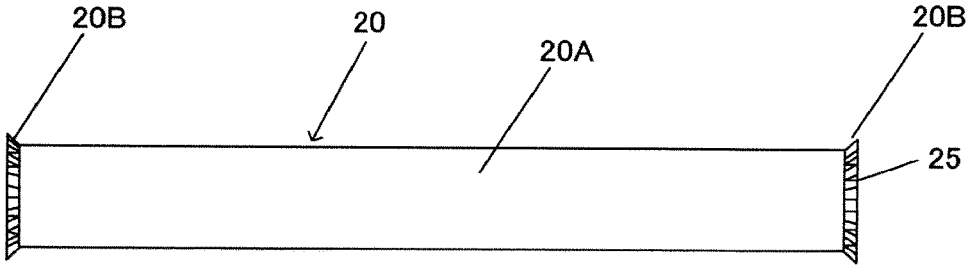
FIG. 4A is a top view illustrating a first variation of the platen roller 20.
Figure 4B:
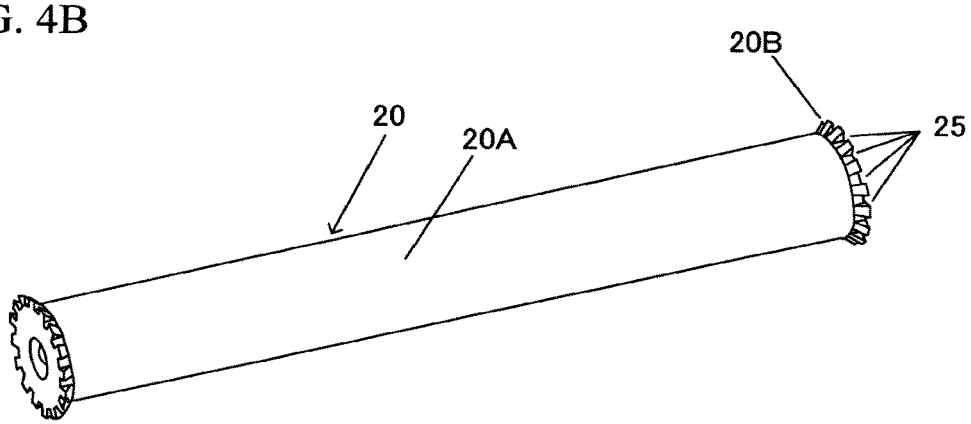
FIG. 4B is a perspective view illustrating the first variation of the platen roller 20.
Figure 4C:
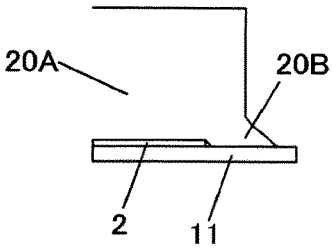
FIG. 4C is a diagram illustrating a normal deformation state of the taper part 20B at a lowest point.
Figure 4D:
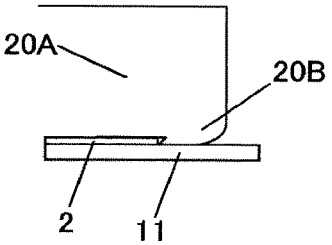
FIG. 4D is a diagram illustrating an abnormal deformation state of the taper part 20B at the lowest point.

FIG. 4A is a top view illustrating a first variation of the platen roller 20. FIG. 4B is a perspective view illustrating the first variation of the platen roller 20. FIG. 4C is a diagram illustrating a normal deformation state of the taper part 20B at a lowest point. FIG. 4D is a diagram illustrating an abnormal deformation state of the taper pan 20B at the lowest point.

In FIGS. 4A and 4B, the taper pan 20B is formed so that the diameter increases towards the outside from the straight part 20A along the axial direction, as with FIG. 2A, and further a plurality of grooves 25 in parallel with the axial direction are formed on the surface of the taper part 20B.

When the platen roller 20 is mounted on the concave parts 13, the lowest point of the taper part 20B usually deforms toward the outside of the platen roller 20, as illustrated in FIG. 4C.

On the other hand, when the platen roller 20 is mounted on the concave parts 13, the lowest point of the taper part 20B may deform toward the inside of the platen roller 20 as illustrated in FIG. 4D by a mounting failure. Thus, even when the lowest point of the taper part 20B deforms in an unintentional direction, since the plurality of grooves 25 in parallel with the axial direction are formed on the taper part 20B, the taper part 20B deformed in the unintentional direction can return to an original shape by the rotation of the platen roller 20.

Figure 5A:
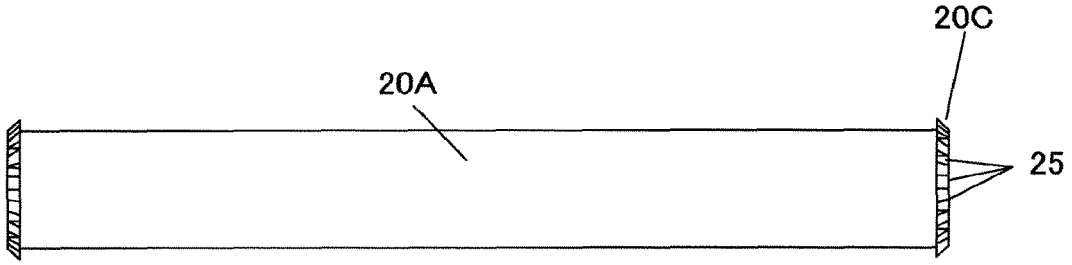
FIG. 5A is a top view illustrating a second variation of the platen roller 20.
Figure 5B:
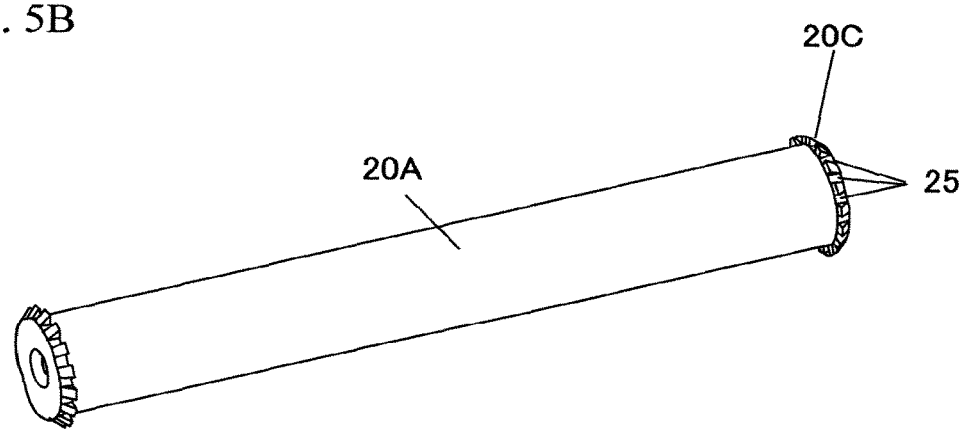
FIG. 5B is a perspective view illustrating the second variation of the platen roller 20.
Figure 5C:
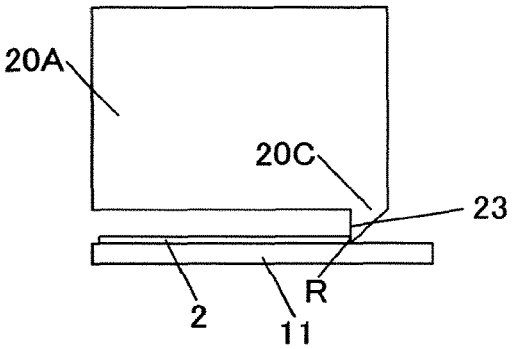
FIG. 5C is a partial cross sectional view of the thermal head 11, the platen roller 20 according to the second variation, and a right end R of the sheet 2.

FIG. 5A is a top view illustrating a second variation of the platen roller 20. FIG. 5B is a perspective view illustrating the second variation of the platen roller 20. FIG. 5C is a partial cross sectional view of the thermal head 11, the platen roller 20 according to the second variation, and the right end R of the sheet 2.

As illustrated in FIGS. 5A and 5B, the platen roller 20 according to the second variation includes the columnar straight part 20A, and taper parts 20C that are formed on both ends of the straight part 20A and have a diameter which decreases towards the outside from the straight part 20A along the axial direction. As illustrated in FIG. 5C, an end part of each taper part 20C at a side of the straight part 20A includes a wall part 23 substantially perpendicular to the thermal head 11. A diameter of the wall part 23 is larger than the diameter of the straight part 20A, and a diameter of an opposite end of each taper part 20C is the same as the diameter of the straight part 20A. The taper parts 20C are formed integrally with the straight part 20A, but may be separated from the straight part 20A. Moreover, the plurality of grooves 25 in parallel with the axial direction are formed on the taper parts 20C.

When the plurality of grooves 25 are not formed on the taper parts 20C, the wall part 23 contacts the right end R of the sheet 2 and prevents the sheet 2 from skewing so that the sheet 2 does not protrude to the outside of the straight part 20A, as illustrated in FIG. 5C.

On the other hand, when the plurality of grooves 25 are formed on the taper parts 20C, the sheet 2 cannot be sufficiently nipped between the grooves 25 and the thermal head 11, and hence the sheet 2 may protrude to the outside of the straight part 20A.

Figure 6A:
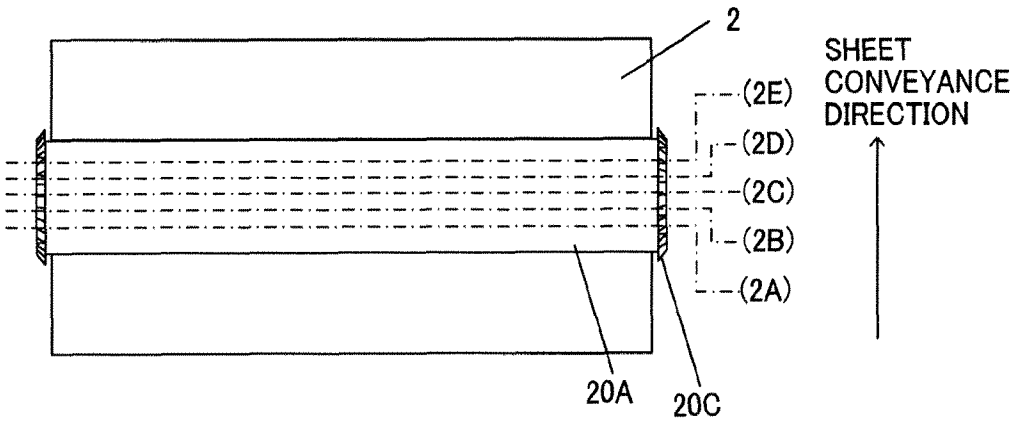
FIG. 6A is a diagram illustrating the position relationship of the sheet 2 and the platen roller 20 according to the second variation.
Figure 6B:
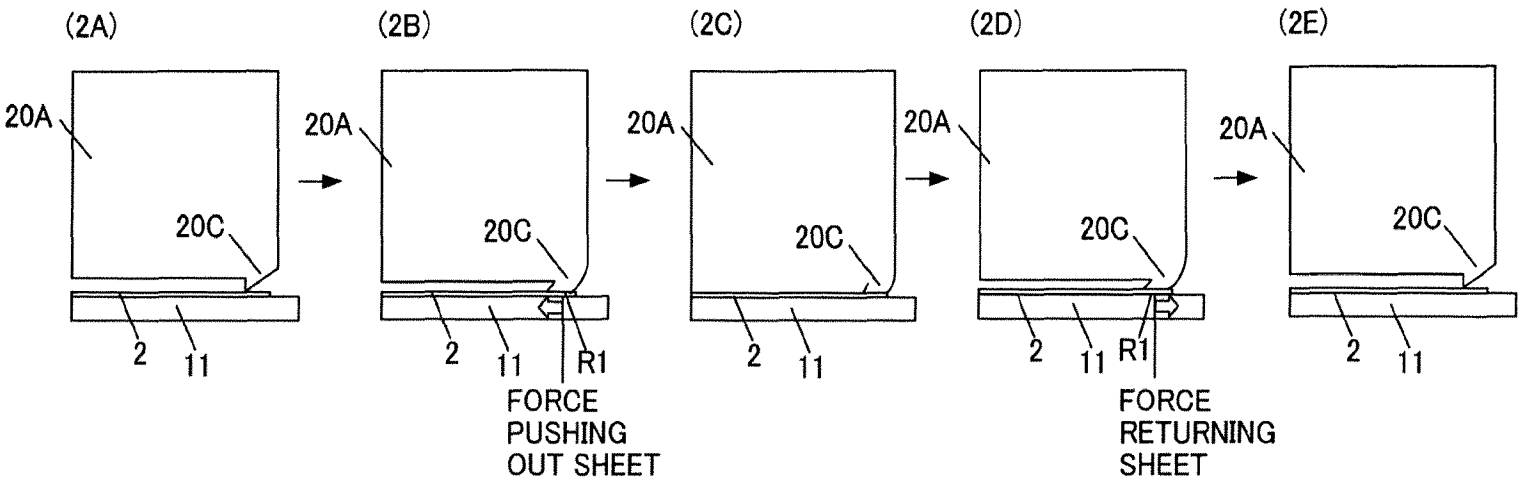
FIG. 6B is a diagram illustrating the state transition of the thermal head 11, the sheet 2 and a taper part 20C of the platen roller 20 according to the second variation.

FIG. 6A is a diagram illustrating the position relationship of the sheet 2 and the platen roller 20 according to the second variation. FIG. 6B is a diagram illustrating the state transition of the thermal head 11, the sheet 2 and the taper part 20C of the platen roller 20 according to the second variation. Codes "2A" to "2E" of FIG. 6A indicate positions of the platen roller 20 opposite to the sheet 2, respectively. Codes "2A" to "2E" of FIG. 6B illustrate partial cross sectional views of right ends of the thermal head 11, the platen roller 20 according to the second variation and the sheet 2. It is assumed that a part of the sheet 2 protrudes to a position opposite to the taper part 20C in FIG. 6B.

First, at the position "2A" of FIG. 6B, the taper part 20C begins the deformation and lightly contacts the thermal head 11 via the sheet 2. At the position "2B" of FIG. 6B, the taper part 20C continues the deformation and contacts a right end R1 of an upper surface of the sheet 2 in a surface contact manner. When the taper part 20C contacts the right end R1 of the upper surface of the sheet 2 in the surface contact manner, a force that pushes out the sheet 2 to the inside of the platen roller 20 is applied to the right end R of the upper surface of the sheet 2, by the frictional force between the taper part 20C and the sheet 2 and the deformation of the taper part 20C. However, the sheet 2 is nipped between the taper part 20C and the thermal head 11, and therefore the sheet 2 does not jump out to the outside of the platen roller 20.

A position "2C" of FIG. 6B is the lowest point of the platen roller 20. The taper part 20C is crushed, the sheet 2 is nipped between the platen roller 20 and the thermal head 11, and printing is performed. Also, the sheet 2 is nipped between the taper part 20C and the thermal head 11, and therefore the sheet 2 does not jump out to the outside of the platen roller 20. At a position "2D" of FIG. 6B, the deformation of the taper part 20C begins to be restored, and the taper part 20C contacts the right end R1 of the upper surface of the sheet 2, and a force that returns the sheet 2 to the outside of the platen roller 20 is applied to the right end R1 of the upper surface of the sheet 2. At the position "2E" of FIG. 6B, the deformation of the taper part 20C is restored, the taper part 20C lightly contacts the thermal head 11 via the sheet 2.

As described above, the platen roller 20 includes the taper parts 20C that are formed on both ends of the straight part 20A and have the diameter which decreases towards the outside from the straight part 20A along the axial direction. Therefore, even when the part of the sheet 2 protrudes to the position where it is nipped between the taper part 20C and the thermal head 11, the sheet 2 does not jump out to the outside of the platen roller 20. It is possible to prevent the sheet 2 from folding. Moreover, since the platen roller 20 includes the columnar straight part 20A which has no irregularity, the force in which the right and left ends of the sheet 2 advance to the central part of the platen roller 20 does not occur in the sheet 2, and it is possible to prevent the wrinkle from occurring on the sheet 2.

Figure 7:
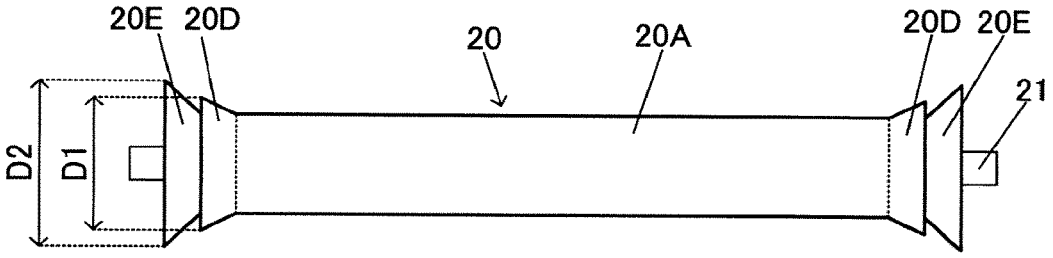
FIG. 7 is a top view illustrating a third variation of the platen roller 20.

FIG. 7 is a top view illustrating a third variation of the platen roller 20.

The platen roller 20 includes the columnar straight part 20A, first taper parts 20D that are formed on both ends of the straight part 20A and have a diameter D1 which increases towards the outside from the straight part 20A along the axial direction, and second taper parts 20E that are formed on the outside of the first taper parts 20D along the axial direction and have a diameter D2 which continuously increases towards the outside from the straight part 20A along the axial direction and is larger than the diameter D1 of the first taper parts 20D. The straight part 20A, the first taper parts 20D and the second taper parts 20E are formed integrally with each other, but may be formed separately from each other. Here, each of the first taper parts 20D and the second taper parts 20E may include the plurality of grooves 25 in parallel with the axial direction.

In the structure of FIG. 7, even when the part of the sheet 2 protrudes to a position opposite to the second taper part 20E over the first taper part 20D, the sheet 2 does not jump out to the outside of the platen roller 20. It is possible to prevent the sheet 2 from folding.

Figure 8A:
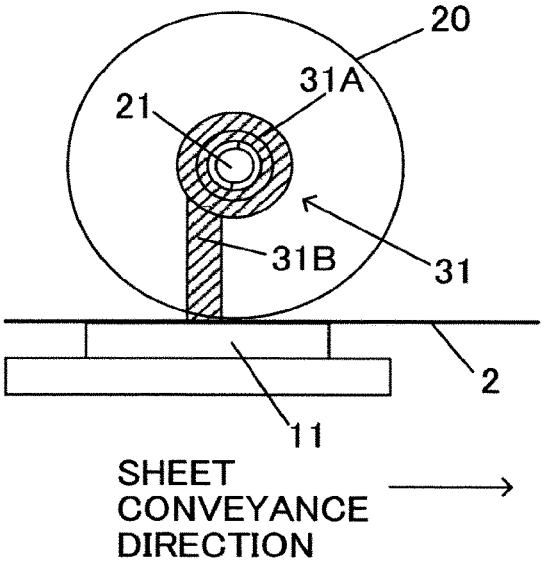
FIG. 8A is a diagram illustrating the position relationship of the sheet 2, the thermal head 11, and the platen roller 20 and a shield 31 which are mounted on a shaft 21.
Figure 8B:
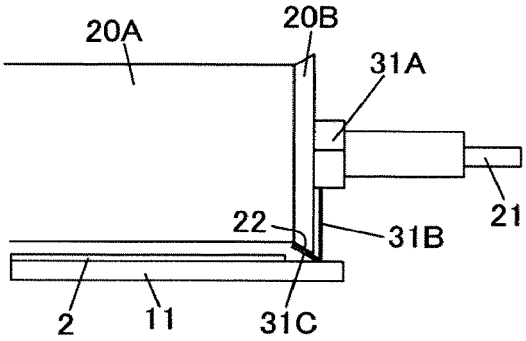
FIG. 8B is a top view illustrating a part of the platen roller 20 and the shield 31 which are mounted on the shaft 21.
Figure 8C:
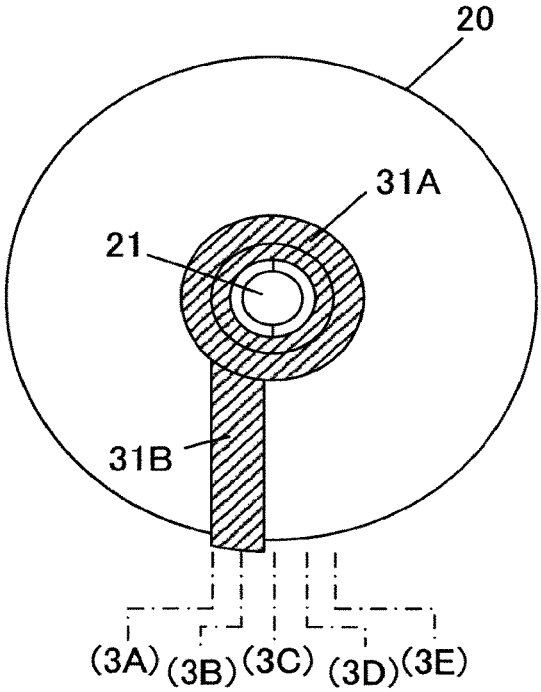
FIG. 8C is a side view illustrating the platen roller 20 and the shield 31 which are mounted on the shaft 21.
Figure 9:
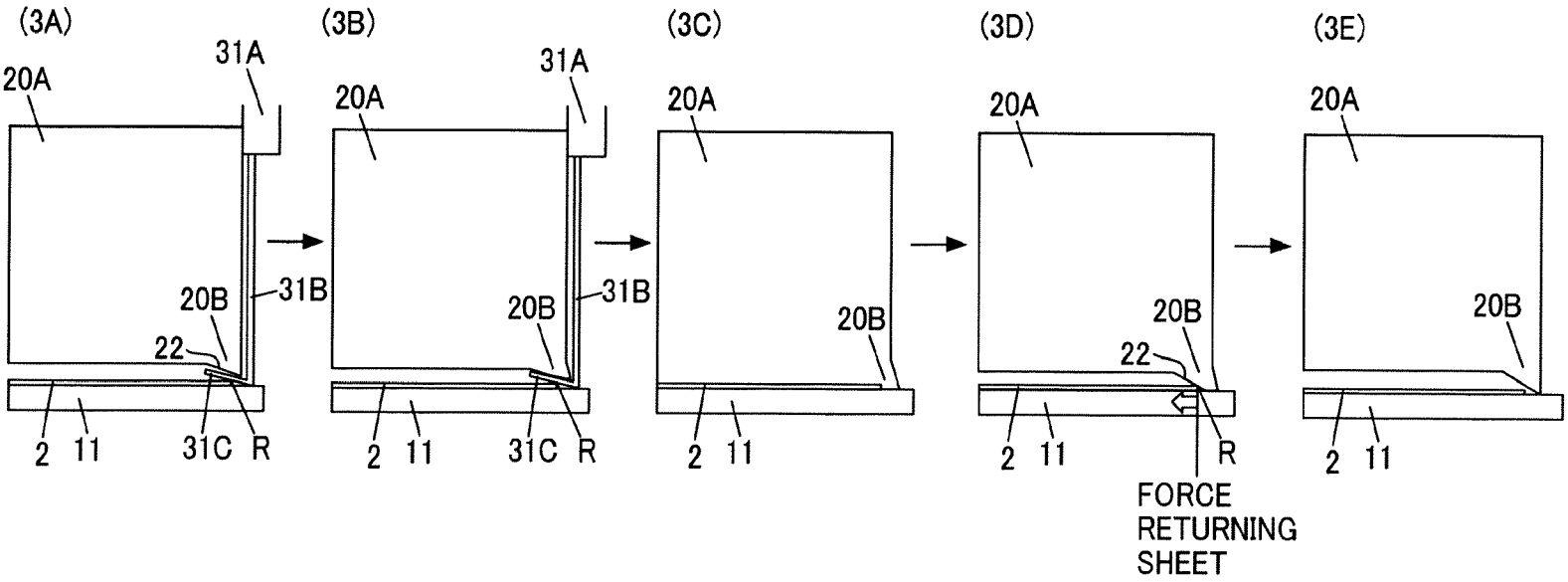
FIG. 9 is a diagram illustrating the state transition of the shield 31, the thermal head 11, the taper part 20B of the platen roller 20 and the sheet 2.

FIG. 8A is a diagram illustrating the position relationship of the sheet 2, the thermal head 11, and the platen roller 20 and a shield 31 which are mounted on the shaft 21. FIG. 8B is a top view illustrating a part of the platen roller 20 and the shield 31 which are mounted on the shaft 21. FIG. 8C is a side view illustrating the platen roller 20 and the shield 31 which are mounted on the shaft 21. FIG. 9 is a diagram illustrating the state transition of the shield 31, the thermal head 11, the taper part 20B of the platen roller 20 and the sheet 2. Here, the platen roller 20 of FIGS. 8A to 8C and 9 is the same as that of FIG. 2A.

Codes "3A" to "3E" of FIG. 9 correspond to positions "3A" to "3E" of FIG. 8C, respectively, and indicate the state of the shield 31, the thermal head 11, the taper part 20B of the platen roller 20 and the sheet 2 at the respective positions.

As illustrates in FIGS. 8A and 8B, the shaft 21 axially passes through the center of the platen roller 20 and the shield 31, and the shield 31 is provided on both ends of the platen roller 20. The shield 31 includes a ring-like mounting part 31A and a plate-like cover part 31B. The mounting part 31A is fixed to the shaft 21. The cover part 31B extends in a radial direction of the platen roller 20 from the mounting part 31A and is bent along the shape of the taper part 20B so as to cover a part of the taper part 20B. The cover part 31B is made of an elastic body such as a plate spring. An apical part 31C of the cover part 31B is nipped between the platen roller 20 and the thermal head 11 or the sheet 2, and is elastically deformable. The apical part 31C of the cover part 31B prevents the sheet 2 from contacting the taper part 20B in order to prevent the sheet 2 from moving toward the outside from the straight part 20A. Even when the apical part 31C of the cover part 31B contacts the sheet 2, the frictional force does not almost act between the apical part 31C and the sheet 2.

As illustrated in FIG. 8C and FIG. 9, the apical part 31C of the cover part 31B is formed at positions corresponding to the positions "3A" and "3B". That is, the apical part 31C of the cover part 31B covers a domain of the inclined plane 22 of the taper part 20B between a position where the taper part 20B begins the deformation by the pressure from the thermal head 11 and a position just before the lowest point "3C" of the taper part 20B.

At the position "3A" of FIGS. 8C and 9, the taper part 20B begins the deformation. The taper part 20B lightly contacts the apical part 31C of the cover part 31B and does not the sheet 2. At the position "3B" of FIGS. 8C and 9, the taper part 20B continues the deformation and the apical part 31C of the cover part 31B contacts the right end R of the sheet 2. Even when the apical part 31C of the cover part 31B contacts the sheet 2, the frictional force does not almost act between the apical part 31C and the sheet 2, and hence the force that pushes out the sheet 2 to the outside of the platen roller 20 does not occur.

A position "3C" of FIGS. 8C and 9 is the lowest point of the platen roller 20. The apical part 31C of the cover part 31B does not cover the taper part 20B. The taper part 20B is crushed, the sheet 2 is nipped between the platen roller 20 and the thermal head 11, and printing is performed. At a position "3D" of FIGS. 8B and 9, the deformation of the taper part 20B begins to be restored, and the inclined plane 22 of the taper part 20B contacts the right end R of the sheet 2. When the inclined plane 22 of the taper part 20B contacts the right end R of the sheet 2, the force that returns the sheet 2 to the inside of the platen roller 20 is applied to the right end R of the sheet 2. At the position "3E" of FIGS. 8B and 9, the deformation of the taper part 20C is restored, the taper part 20B lightly contacts the thermal head 11 and the platen roller 20 does not the sheet 2.

Thus, since the apical part 31C of the cover part 31B covers the domain of the taper part 20B between the position where the taper part 20B begins the deformation by the pressure from the thermal head 11 and the position just before the lowest point "3C" of the taper part 20B, only the force that returns the sheet 2 to the inside of the platen roller 20 is applied to the sheet 2, as illustrated at the position "3D" of FIGS. 8C and 9. Therefore, it is possible to prevent the sheet 2 from skewing and prevent the sheet 2 from folding. Moreover, since the platen roller 20 includes the columnar straight part 20A which has no irregularity, the force in which the right and left ends of the sheet 2 advance to the central part of the platen roller 20 does not occur in the sheet 2, and it is possible to prevent the wrinkle from occurring on the sheet 2.

Figure 10A:
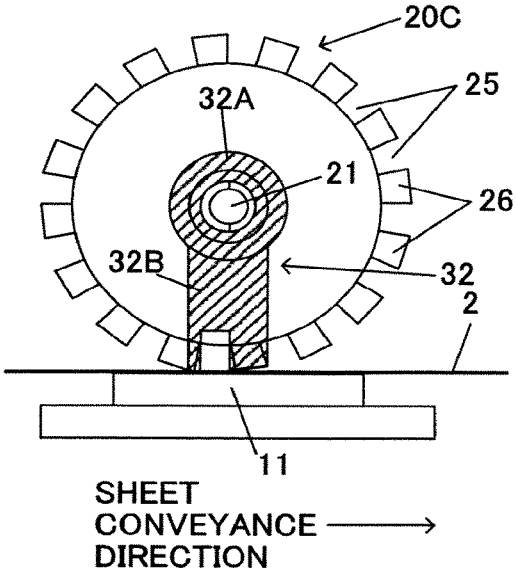
FIG. 10A is a diagram illustrating the position relationship of the sheet 2, the thermal head 11, and the platen roller 20 of the second variation and a shield 32 which are mounted on the shaft 21.
Figure 10B:
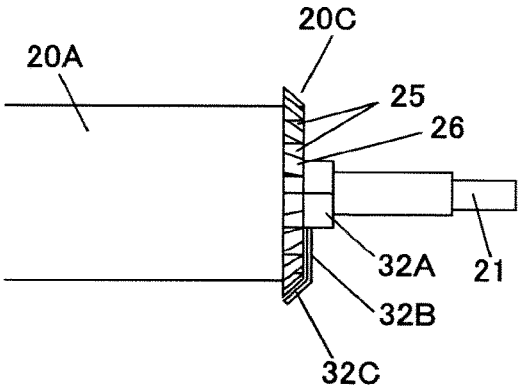
FIG. 10B is a top view illustrating a part of the platen roller 20 of the second variation and the shield 32 which are mounted on the shaft 21.
Figure 10C:
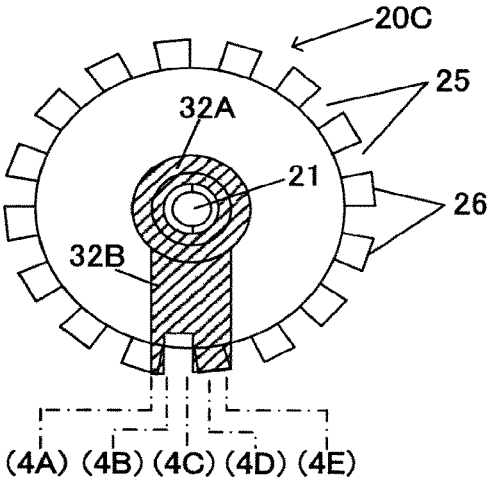
FIG. 10C is a side view illustrating the platen roller 20 of the second variation and the shield 32 which are mounted on the shaft 21.
Figure 11:
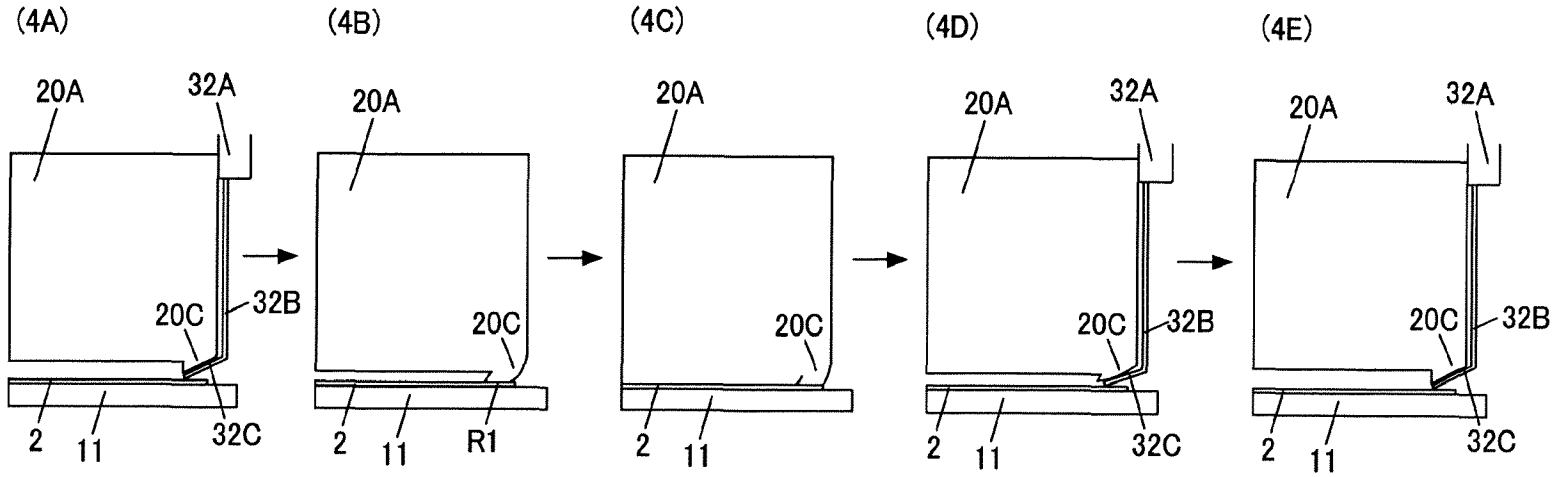
FIG. 11 is a diagram illustrating the state transition of the shield 32, the thermal head 11, the sheet 2 and the taper part 20C of the platen roller 20 according the second variation.

FIG. 10A is a diagram illustrating the position relationship of the sheet 2, the thermal head 11, and the platen roller 20 of the second variation and a shield 32 which are mounted on the shaft 21. FIG. 10B is a top view illustrating a part of the platen roller 20 of the second variation and the shield 32 which are mounted on the shaft 21. FIG. 10C is a side view illustrating the platen roller 20 of the second variation and the shield 32 which are mounted on the shaft 21. FIG. 11 is a diagram illustrating the state transition of the shield 32, the thermal head 11, the sheet 2 and the taper part 20C of the platen roller 20 according the second variation. Here, the platen roller 20 of FIGS. 10A to 10C and 11 is the same as that of FIG. 5A.

Codes "4A" to "4E" of FIG. 11 correspond to positions "4A" to "4E" of FIG. 10C, respectively, and indicate the state of the shield 32, the thermal head 11, the taper part 20C of the platen roller 20 and the sheet 2 at the respective positions.

As illustrated in FIGS. 10A and 10B, projections 26 and the grooves 25 are alternately formed on a periphery of the taper part 20C. The shaft 21 axially passes through the center of the platen roller 20 and the shield 32, and the shield 32 is provided on both ends of the platen roller 20. The shield 32 includes a ring-like mounting part 32A and a plate-like cover part 32B. The mounting part 32A is fixed to the shaft 21. The cover part 32B extends in a radial direction of the platen roller 20 from the mounting part 32A and is bent along the shape of the taper part 20C so as to cover a part of the taper part 20C.

The cover part 32B is made of the elastic body such as the plate spring. An apical part 32C of the cover part 32B is nipped between the platen roller 20 and the thermal head 11 or the sheet 2, and is elastically deformable. The apical part 32C of the cover part 32B prevents the sheet 2 from contacting the taper part 20C in order to prevent the sheet 2 from moving toward the outside from the straight part 20A. Even when the apical part 32C of the cover part 32B contacts the sheet 2, the frictional force does not almost act between the apical part 32C and the sheet 2.

As illustrated in FIG. 10C and FIG. 1, the apical part 32C of the cover part 32B is formed at positions corresponding to the positions "4A", "4D" and "4E". The apical part 32C of the cover part 32B covers a domain of the taper part 20C between a position just behind the lowest point of the taper part 20C and a position where the taper part 20B finishes the deformation, and a part of the projection 26 adjacent to the domain via the groove 25 in the conveyance direction of the sheet. That is, the apical part 32C of the cover part 32B covers a domain of the taper part 20C generating the force that pushes out the sheet 2 to the outside of the platen roller 20.

At the position "4A" of FIGS. 10C and 11, the deformation of the taper part 20C is finished. The apical part 32C of the cover part 32B lightly contacts the sheet 2. At a position "4B" of FIGS. 10C and 11, the apical part 32C of the cover part 32B does not cover the taper part 20C. The taper part 20C resumes the deformation and contacts the right end R1 of the upper surface of the sheet 2, and the force that returns the sheet 2 to the inside of the platen roller 20 is applied to the right end R1 of the upper surface of the sheet 2.

The position "4C" of FIGS. 10C and 11 is the lowest point of the platen roller 20. The apical part 32C of the cover part 32B does not cover the taper part 20C. The taper part 20C is crushed, the sheet 2 is nipped between the platen roller 20 and the thermal head 11, and printing is performed. At the position "4D" of FIGS. 10C and 11, the apical part 32C of the cover part 32B covers the taper part 20C. The deformation of the taper part 20C begins to be restored and the apical part 32C of the cover part 32B contacts the sheet 2, but the frictional force does not almost act between the apical part 32C and the sheet 2. Therefore, the force that pushes out the sheet 2 to the outside of the platen roller 20 does not occur. At the position "4E" of FIGS. 10C and 11, the apical part 32C of the cover part 32B covers the taper part 20C. The deformation of the taper part 20C is restored, and the apical part 32C of the cover part 32B lightly contacts the sheet 2.

Thus, since the apical part 32C of the cover part 32B covers the domain (i.e., the positions 4A, 4D and 4E) of the taper part 20C generating the force that pushes out the sheet 2 to the outside of the platen roller 20, only the force that returns the sheet 2 to the inside of the platen roller 20 is applied to the sheet 2, as illustrated at the position "4B" of FIGS. 10C and 11. Therefore, it is possible to prevent the sheet 2 from skewing and prevent the sheet 2 from folding. Moreover, since the platen roller 20 includes the columnar straight part 20A which has no irregularity, the force in which the right and left ends of the sheet 2 advance to the central part of the platen roller 20 does not occur in the sheet 2, and it is possible to prevent the wrinkle from occurring on the sheet 2.

Figure 12A:
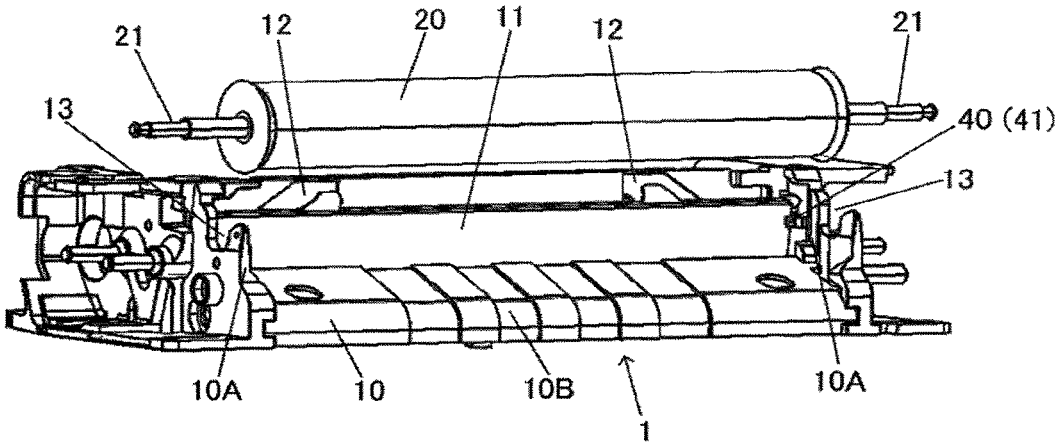
FIG. 12A is a diagram illustrating a variation of a platen roller unit 1.
Figure 12B:
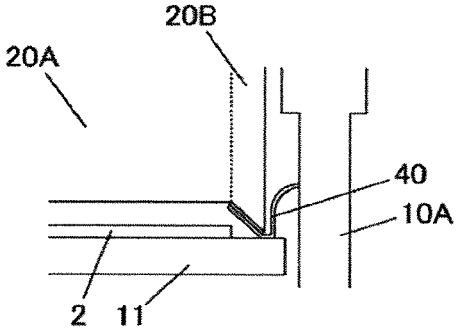
FIG. 12B is a diagram illustrating a first variation of a shield 40.
Figure 12C:
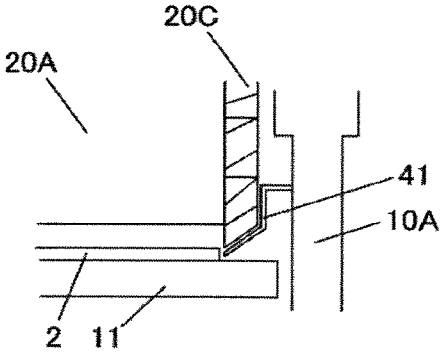
FIG. 12C is a diagram illustrating a first variation of a shield 41.

FIG. 12A is a diagram illustrating a variation of the platen roller unit 1. FIG. 12B is a diagram illustrating a first variation of a shield 40. FIG. 12C is a diagram illustrating a first variation of a shield 41.

As illustrated in FIGS. 8B and 10B, each of the shields 31 and 32 is fixed to the shaft 21.

As illustrated in FIGS. 12A and 12B, a pair of shields 40 fixed to the right and left wall parts 10A of the housing 10 may be provided to prevent the sheet 2 from contacting the taper part 20B, as a substitute for the shield 31. In this case, a domain where the shield 40 covers the taper part 20B is the same as the domain where the shield 31 covers the taper part 20B.

As illustrated in FIGS. 12A and 12C, a pair of shields 41 fixed to the right and left wall parts 10A of the housing 10 may be provided to prevent the sheet 2 from contacting the taper part 20C, as a substitute for the shield 32. In this case, a domain where the shield 41 covers the taper part 20C is the same as the domain where the shield 32 covers the taper part 20C.

Thus, also when the shield 40 or 41 is fixed to the wall parts 10A of the housing 10, it is possible to prevent the sheet 2 from skewing and prevent the sheet 2 from folding.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A printer comprising:

a platen roller;

a housing that holds the platen roller; and a print head that is mounted on the housing and performs printing on a sheet;

wherein the platen roller includes a columnar straight part with two ends, and first taper parts that are respectively formed on the two ends of the columnar straight part, each of which first taper parts has a diameter which changes equally towards an outside from the columnar straight part along an axial direction, and which first taper parts are deformable by contact with the print head.

2. The printer as claimed in claim 1, wherein the diameter of each of the first taper parts continuously increases towards the outside from the columnar straight part.

3. The printer as claimed in claim 1, wherein a periphery of each of the first taper parts includes a plurality of grooves in parallel with the axial direction.

4. The printer as claimed in claim 1, wherein the platen roller further includes second taper parts, each of which is formed on the outside of the first taper parts, respectively, and has a diameter which increases towards the outside from the columnar straight part along the axial direction and is larger than the diameter of each of the first taper parts.

5. The printer as claimed in claim 1, wherein the diameter of each of the first taper parts decreases towards the outside from the columnar straight part along the axial direction.

6. The printer as claimed in claim 1, further comprising:

a shield that covers a part of one of the first taper parts generating a force that pushes out the sheet in an outside direction of the platen roller.

7. A printer, comprising:

a platen roller;

a housing that holds the platen roller; and a print head that is mounted on the housing opposite to and contacting the platen roller to print on a sheet;

wherein the platen roller includes a columnar straight part with two ends, and first taper parts that are respectively formed on the two ends of the columnar straight part, wherein each taper part has a diameter which changes towards an outside from the columnar straight part along an axial direction of the platen roller, and wherein the diameter of an end part of each of the first tapers is larger than a diameter of the columnar straight part.

* * * * *